United States Patent [19]

Singer et al.

[11] 4,292,013

[45] Sep. 29, 1981

[54] ROTARY IMPELLER OR MOTOR WITH PRESSURE BALANCED END PLATES

[75] Inventors: Carl M. Singer, New Castle, Pa.; Edward J. Ratkay, Canfield, Ohio

[73] Assignee: Commercial Shearing, Inc., Youngstown, Ohio

[21] Appl. No.: 24,612

[22] Filed: Mar. 28, 1979

[51] Int. Cl.[3] ..... F03C 2/08; F04C 2/18; F04C 15/00

[52] U.S. Cl. ..... 418/132

[58] Field of Search ..... 418/131, 132

[56] References Cited

U.S. PATENT DOCUMENTS

| | | | |
|---|---|---|---|
| 2,714,856 | 8/1955 | Kane | 418/132 |
| 2,969,744 | 1/1961 | Hoffer | 418/132 |
| 3,263,620 | 8/1966 | Schofield | 418/132 |
| 3,309,997 | 3/1967 | Kita | 418/132 |

FOREIGN PATENT DOCUMENTS

| | | | |
|---|---|---|---|
| 39-16302 | 7/1964 | Japan | 418/131 |
| 434187 | 10/1974 | U.S.S.R. | 418/131 |

*Primary Examiner*—John J. Vrablik

*Attorney, Agent, or Firm*—Buell, Blenko, Ziesenheim & Beck

[57] ABSTRACT

A rotary impeller pump or motor is provided having a case, a pair of rotary impellers in said case, a plate having a first face divided by lands into a plurality of chambers against corresponding ends of the impellers and a second face divided by sealing means into a similar plurality of chambers between the plate and case, opposed inlet and outlet ports in said case whereby said plate is balanced in pressure on opposite sides by fluid in said chambers on the first and second faces.

12 Claims, 5 Drawing Figures

ROTARY IMPELLER OR MOTOR WITH PRESSURE BALANCED END PLATES

This invention relates to rotary pumps and motors and particularly to pumps and motors with rotary impellers and to means for sealing the ends of said impellers.

Rotary pumps and motors such as for example gear pumps, have a pair of impellers in the form of meshing gears and a case extending, closely around a portion of the periphery of each impeller to cooperate with the impeller teeth in trapping fluid on the low pressure side of the pump and carrying it to the high pressure side of the pump. The meshed teeth prevent any substantial return flow between the impellers as a result of the pressure differential between the outlet and inlet sides of the pump. End plates are provided to limit the return flow between the ends of the impellers, which are rotating, and the case. A major problem in such pumps and motors is that of adjusting the end plates so that they are tight enough to prevent any substantial return flow and yet loose enough to prevent the impellers from bein seized and stopped. Since the impellers are generally made of steel and the end plates are made of bronze there is further complication that the bronze expands at a higher rate than the steel with increases in temperature so that the end plates must be smaller in diameter than the impeller to compensate for this. Finally, the enclosed end plates are preferably arranged to "float" relative to the impeller ends, with the face of the plate opposite the impeller being subject to pressure of fluid from the outlet side of the pump for the purpose of creating a balancing pressure urging the plate against the impeller ends to create the desired seal. This produces a very real problem created by the fact that the fluid pressures on the faces of the plate adjacent the impeller differ greatly from the outlet side to the inlet side which results in an unbalance pressure and in some cases seizure of the impeller and plate. These problems have long been recognized in the art and are discussed in Patton U.S. Pat. No. 1,972,632 and Kane U.S. Pat. No. 2,714,856, both of which patents offer solutions to these problems, which under proper circumstances have worked well and efficiently. However, modern technology has required that pumps and motors be operated at higher and higher pressures which have aggravated the problems to the point where prior art solutions are no longer applicable.

We have invented a new form of rotary pump and motor construction which eliminates these problems even at very high pressures. We provide novel end plates for engaging the ends of the rotary impellers, which impellers provide a degree of uniform balancing of pressure heretofore impossible in rotary motors and pumps. The end plates are symmetrical and thus permit reversal of flow through the pump or motor. In view of the improved balancing action, the life of the end plates is markedly improved along with the efficiency of the pump.

Preferably we provide a rotary pump and motor comprising a rotary impeller, a plate against an end of the rotary impeller and a case enclosing the plate and impeller with a portion of the case fitting closely around a portion of the impeller to trap fluid therebetween, diametrically opposed outlet and inlet ports in said case and with the periphery of the plate extending in contact with the case generally around its periphery, at least one notch in the periphery of the plate adjacent each of the outlet and inlet ports, at least one notch in the periphery of the plate spaced intermediate the notches at the inlet and outlet ports, said notches providing communication from one side of the plate to the other, a valley portion on the face of said plate at each notch, and a land between each of the valley portions bearing against the impeller to sealingly separate said valley portions and notches. Preferably the pump or motor has a pair of rotary impellers and the plates are in the form of a figure 8 with the impeller axes generally concentric with the circular openings in the figure 8. Preferably the plate has a valley extending across the opposite ends of the figure 8 on the face which bears on the impellers and spaced from the circular openings by a land, and a pair of valleys, one of each side of a centerline through the figure 8 and spaced from the circular openings and from each other by a land. The valleys are pressurized by fluid from the pump interior, the two valleys at the inlet and outlet ports are pressurized by fluid at each of those parts whereas the valleys at the opposite ends are pressurized by fluid under pressure from the impeller. These fluid forces produce counter forces between the impellers and plate which reduces the wear on both the gears and plates, increases the permissible speed of operation and the permissible pressure and reduces the heating of the fluid.

In the foregoing general description, we have set out certain objects, advantages and purposes of the invention. Other objects, purposes and advantages will be apparent from a consideration of the following description and the accompanying drawings in which.

Figure 1:
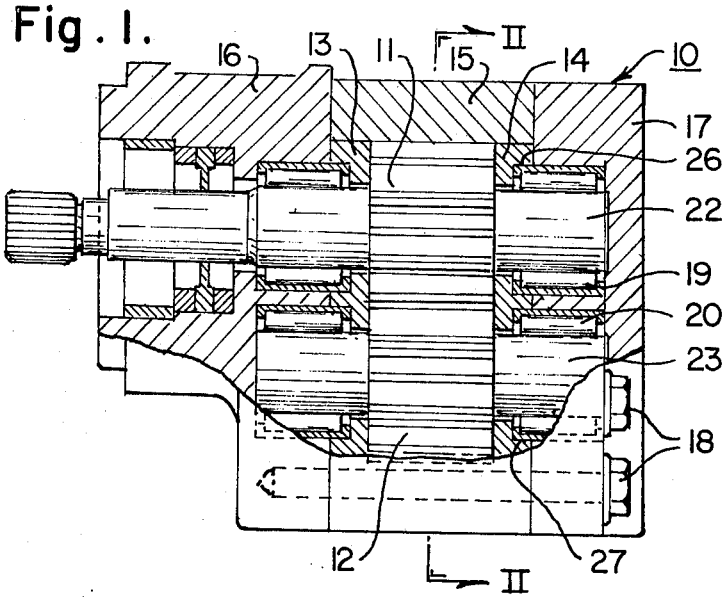
FIG. 1 is a sectional view of a rotary pump and motor taken through the impeller axes.

Referring to the drawings, we have illustrated a gear pump 10, which is also usable as a motor, having a pair of meshing gear impellers 11 and 12 between a pair of end plates 13 and 14 with a central casing member 15 enclosing the outer peripheries of the impellers and plates. Ports 15*a* and 15*b* through the casing member 15 serve interchangeably as inlet and outlet ports for the pump. The plates 13 and 14 and casing member 15 are enclosed between a pair of end casing members 16 and 17, and bolts 18 extend through casing members 15 and 17 and threadingly screw into casing member 16 to hold the casing members together in tightly sealed relation. The inner side of the casing member 17 lies in a continuous flat plane except for a pair of cylindrical depressions into which bearings 19 and 20 are fitted. Hollow cylindrical hubs 22 and 23 are supported in bearings 19 and 20.

Figure 3:
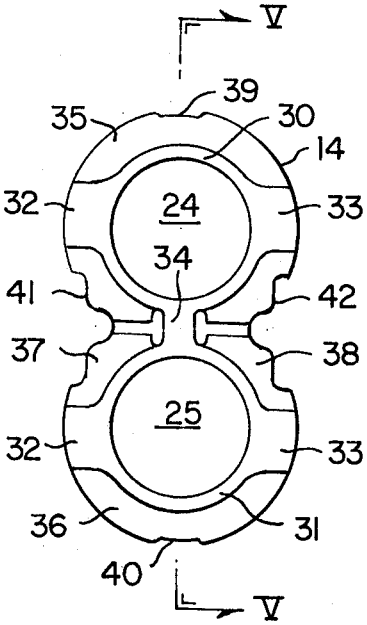
FIG. 3 is a view of an end plate showing its front face which engages the impeller ends.
Figure 2:
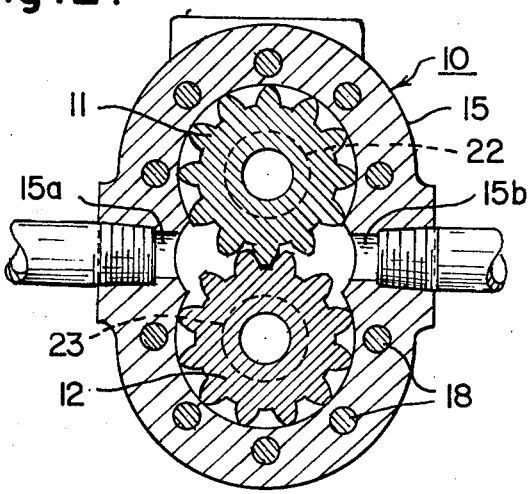
FIG. 2 is a sectional view on the line II—II of FIG. 1.
Figure 4:
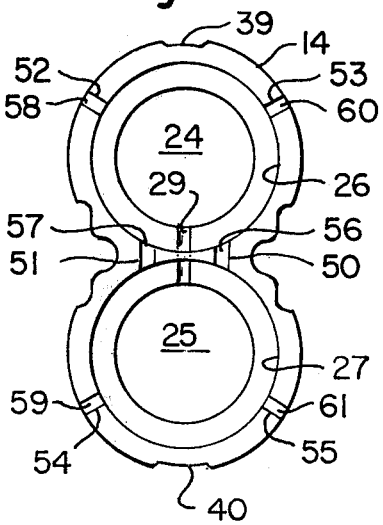
FIG. 4 is a view of the rear face of the end plate FIG. 3.
Figure 5:
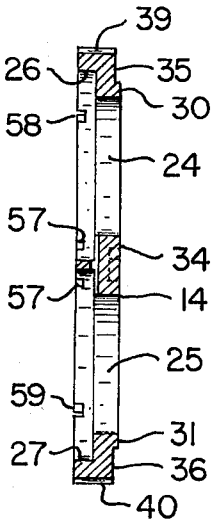
FIG. 5 is a sectional view of the end plate taken on the line V—V of FIG. 3.

Plate 14, which is identical with plate 13, will be described in detail. The plate 14 has a pair of openings 24 and 25 through which hubs 22 and 23 extend, and these openings are countersunk on the rear face of the plate to provide counterbores 26 and 27 fitting closely around the projecting ends of the bearing shells 19 and 20 FIG. 1). The front face of plate 14, illustrated in FIG. 3, is in the form of a figure 8 having an annular land 30 and 31, surrounding each of openings 24 and 25 connected to opposed radial lands 32 and 33 and transverse land 34 extending between lands 30 and 31. The portion between the lands 30, 31, 32, 33 and 34 is milled away to form chambers 35 and 36 at opposite ends of plate 14 and chambers 37 and 38 at the inlet and outlet sides of plate 14. These chambers 35, 36, 37 and 38 are of quite shallow depth and provide pressure chambers on the face of the plate 14. Notches 39 and 40 at opposite ends of plate 14 communicate from chambers 35 and 36 through the periphery of plate 14 to the rear side of the plate. Notches 41 and 42 at the inlet and outlet sides of the periperhy communicate from chambers 37 and 38 to the rear side of plate 14. The rear face of plate 14, illustrated in FIG. 4, is, of course, likewise in the form of a figure 8 with flat surfaces paralleling the adjacent flat surface of the casing member 17 and with a passage 29 and a pair of channels 50, 51 between the counterbores 26 and 27. A pair of spaced channels 52, 53, 54 and 55 divide the semicircular outer ends of the figure 8 from its central portion and along with channels 50, 51 receive elastomer seal members 56, 57, 58, 59, 60 and 61 which separate the outer ends from the central portion into separate pockets or chambers. Each of the seals is as long as the corresponding channel and extends slightly above the top of the channel to seal against the surface of casing 17.

The periphery of plate 14 is notched at each end with notches 39 and 40 and the central portion with notches 41 and 42, as mentioned above, all of which extend the full width of the plate. The notches serve two functions; they permit communication from one side to the other of plate 14 and they prevent buckling of the plate from heating during operation.

Plate 13 corresponds identically with plate 14 in construction, mounting and operation and will not be described in detail. The end casing memer 16 cooperates with plate 13 in the same manner as the opposite end casing 17 cooperates with plate 14.

In operation the chambers 35 and 36 and the area between channels 52 and 53 at one end and channels 54 and 55 at the other end are pressurized by fluid between the casing and the impeller so that the plate ends are fully balanced. Similarly, the chamber 15 on the front and the area defined by channels 52, 54 and 51 on the rear are subject to the inlet pressure and chamber 16 on the front and the area defined by channels 53, 55 and 50 are subject to the outlet pressure, thus balancing ring 13 and 14 in sealing relation between casing members 16 and 17 and impellers 11 and 12.

In the foregoing specification we have set out certain preferred embodiments of our invention, however, the invention may be otherwise embodied within the scope of the following claims.

We claim:

1. A pressure plate for corresponding ends of a pair of cooperating impellers in a rotary pump or motor comprising a metal body having an inlet and an outlet, said plate having a first face adapted to abut the impeller ends, a pair of openings to receive impeller shafts and a second face generally parallel to said first face, radial resilient sealing means on said second face spaced circumferentially around said openings to restrict flow across said rear face and forming chambers of similar size therebetween, one at the inlet side, one at the outlet side and at least one at each opposite end of said thrust plate intermediate the inlet and outlet sides and a plurality of chambers formed in said first face defined by radial lands corresponding generally to the sealing means on said second face and forming chambers corresponding to the chambers on the second face to restrict flow across said first face in generally the same areas as the seal means on the second face, whereby said plate is generally balanced in use in a pump.

2. A pressure plate for rotary motors and pumps as claimed in claim 1 wherein the seal means are elastomeric members carried in radial channels in the second face.

3. A pressure plate as claimed in claim 1 or 2 in the general form of a figure 8.

4. A pressure plate as claimed in claim 2 wherein the chambers in said first face are milled in said face.

5. A pressure plate as claimed in claim 2 having notches in the periphery of the plate at the diametric opposite ends and at the diametric opposite sides communicating between said first and second face.

6. A pressure plate as claimed in claim 2 having a pair of spaced radial channels extending between said openings and elastomer sealing means therein.

7. A rotary impeller pump or motor having an inlet and an outlet comprising a pair of rotary impellers between said inlet and outlet, a plate having a first face against corresponding ends of the impellers, a case having a first section enclosing the impellers and the periphery of the plate and having a second section enclosing a second face of the plate opposite the impeller, means detachably securing the two sections of case together, the first section having semicircular portions in close fitting engagement with the impellers to trap fluid therebetween and in contact with adjacent portions of the plate periphery, said plate being shiftable in the case axially against the impellers and having a pair of openings therethrough concentric with the respective axes and being counterbored at said openings from the second face of the plate, bearing means carrying the impellers and having a nonrotating outer periphery secured in the second portion of the case and extending into said counterbored portions, resilient radial sealing means spaced circumferentially between the second face of the plate and the second section of the case forming chambers of similar size therebetween, one at the inlet side, one at the outlet side, and at least one at each opposite end of said thrust plate intermediate the outlet and inlet sides bounded by said sealing means, said bearing means and said second section and controlling pressures on the second face of said plate, and a plurality of chambers formed on the first face of said plate adjacent the impellers corresponding generally to the chambers formed by said sealing means and defined by diametrically opposed lands on the first face bearing against the impellers and controlling pressures on the first face of said plate to generally balance the plate against the pressures on the second face whereby said plate is substantially balanced between the impellers and said second section of case.

8. A rotary impeller pump or motor as claimed in claim 7 wherein the sealing means are carried in radial channels spaced around the counterbores in the second face of said plate.

9. A rotary impeller pump or motor as claimed in claims 7 or 8 wherein the chambers in said first face are milled in said face.

10. A rotary impeller pump or motor as claimed in claims 7 or 8 having notches in the periphery of the plate at the diametric opposite ends of said plate and at the diametric opposite sides of said plate communicating between the first and second face.

11. A rotary impeller pump or motor as claimed in claims 7 or 8 having opposed inlet and outlet ports in said case on opposite sides of said impellers, a chamber on each of the first and second faces of the plate adjacent each of the inlet and the outlet ports and a chamber at each end of the plate adjacent the portion of the case and impellers in which fluid is trapped.

12. A rotary impeller pump or motor as claimed in claim 11 wherein a pair of spaced radial channels extend between said two counterbores carrying sealing means.

* * * * *

UNITED STATES PATENT AND TRADEMARK OFFICE

CERTIFICATE OF CORRECTION

PATENT NO. : 4,292,013

DATED : September 29, 1981

INVENTOR(S) : CARL M. SINGER and EDWARD J. RATKAY

It is certified that error appears in the above-identified patent and that said Letters Patent are hereby corrected as shown below:

Column 1, line 23, "bein" should be --being--.

Column 2, line 66, "FIG.1)" should be --(FIG. 1)--.

Column 3, line 43, "chamber 15" should be --chamber 38--.

Column 3, line 45, "chamber 16" should be --chamber 37--.

Signed and Sealed this

*Twenty-third* Day of *March 1982*

|SEAL|

*Attest:*

GERALD J. MOSSINGHOFF

*Attesting Officer*

*Commissioner of Patents and Trademarks*